United States Patent [19]

Nassler

[11] Patent Number: 4,879,750

[45] Date of Patent: Nov. 7, 1989

[54] HEARING AID WITH CERUMEN TRAPPING GAP

[75] Inventor: Peter Nassler, Eckental, Fed. Rep. of Germany

[73] Assignee: Siemens Aktiengesellschaft, Berlin and Munich, Fed. Rep. of Germany

[21] Appl. No.: 807,893

[22] Filed: Dec. 11, 1985

[30] Foreign Application Priority Data

Dec. 15, 1984 [DE] Fed. Rep. of Germany ... 8436783[U]
Feb. 20, 1985 [DE] Fed. Rep. of Germany ... 8504765[U]

[51] Int. Cl.[4] ..... H04R 25/00; H04R 25/02
[52] U.S. Cl. ..... 381/68.6; 381/69
[58] Field of Search ..... 179/107 E, 107 R, 107 H, 179/107 S, 182 R, 184; 381/68.1–68.7, 68, 69

[56] References Cited

U.S. PATENT DOCUMENTS

| | | | |
|---|---|---|---|
| 3,068,954 | 12/1962 | Strzalkowski | 181/135 |
| 3,170,046 | 2/1965 | Leale | 381/68.6 |
| 3,374,318 | 3/1968 | Martin | 381/68.6 |
| 3,408,461 | 10/1968 | Langford | 381/68.6 |
| 3,852,540 | 12/1974 | Diethelm | 381/68.4 |
| 4,447,677 | 5/1984 | Miyahra et al. | 381/69.2 |

FOREIGN PATENT DOCUMENTS

| | | | |
|---|---|---|---|
| 1951165 | 4/1966 | Fed. Rep. of Germany . | |
| 1270616 | 6/1968 | Fed. Rep. of Germany | 381/68.6 |
| 2818273 | 11/1979 | Fed. Rep. of Germany . | |
| 8404016 | 10/1984 | Fed. Rep. of Germany | 381/68 |
| 359163 | 2/1962 | Switzerland | 381/68.6 |
| 2155276 | 9/1985 | United Kingdom | 381/68.6 |

*Primary Examiner*—Jin F. Ng
*Assistant Examiner*—Danita R. Byrd
*Attorney, Agent, or Firm*—Mark H. Jay

[57] ABSTRACT

A hearing aid has a sound-conducting tube, the distal end of which extends into the auditory meatus. The tube is mounted to an earpiece which closes off the ear canal. A protrusion surrounds the distal end and extends from the earpiece. A cap is detachably secured to the protrusion and is perforated to permit sound to travel into the ear, and the cap and the earpiece form a cerumen-trapping gap. The earpiece of the hearing aid has a substantially flat end plate adjacent the protrusion and the end plate bears a groove which surrounds the protrusion.

13 Claims, 2 Drawing Sheets

HEARING AID WITH CERUMEN TRAPPING GAP

BACKGROUND OF THE INVENTION

The invention relates to a hearing aid. Inner-ear hearing aids are introduced deep into the auditory canal so as to be substantially invisible from the outside. The same is true for outer ear hearing aids where the ear mold or ear piece (connected with the apparatus housing via a sound conduction tube) is to be introduced quite deep into the auditory canal. This brings the mouth of the sound conduction line into the zone of the auditory meatus in which secretions called cerumen are deposited. This substance may clog the opening of the sound channel. For this reason so-called cerumen catchers or traps have been provided. These, however, are difficult to keep clean, as in the case of the apparatus of German Utility Model No. 19 51 165, and they generally constitute an undesired enlargement of the housing. In the case of German Offenlegungsschrift No. 28 18 273, the sound exit opening is covered with a rubber cap, which may be formed like a sieve. According to page 4, lines 1 to 5 of this disclosure, the ear mold is always shaped a little bulged, so that the slightly thickened edge of the protective cap can be fixed in a notch already existing or specially created for this purpose. For a still more secure hold of the cap, it may be rubberized internally wholly or partly, so that it sticks. A rubber cap of the kind described has the disadvantage, apart from tearing easily, that after having been fitted over the apparatus part to be introduced into the auditory meatus it applies thereon relatively smoothly, even if its outside is rough. Therefore, the cerumen slides quickly along the protective cap toward the sieve-like openings over the sound channel. Hence the openings become clogged sooner than necessary and accordingly the cap must be replaced more frequently.

One object of the invention is to provide a hearing aid of the initially mentioned kind with a protective device associated with the sound transmission line and effective against secretions of the auditory canal, whereby the cerumen reaches the sieve openings less quickly, so that the protective device requires less frequent replacement or cleaning.

SUMMARY OF THE INVENTION

According to the invention, the protective device comprises, besides the sieve cover, a gap in which the serum collects before it can get via the cover to the sieve openings thereof, clogging them. Thus the openings of the cover are fouled less quickly and accordingly the cover needs to be replaced or cleaned less often.

In a preferred embodiment of the invention, the wall of the apparatus part to be placed in the meatus is formed essentially flat at its proximal end. A projection protrudes from the flat proximal end, the proximal end of the apparatus part having a first diameter and the projection a second diameter smaller than the first. The second diameter is $\frac{1}{3}$ to $\frac{1}{4}$ of the first. In another preferred embodiment the projection protrudes from a plate which is integral with the end plate of the apparatus part to be placed in the meatus.

For the retention of the cover, the cover is anchored at the edge of the opening of the sound conduction line. The cover may be a cap whose inner or outer edge is designed to form a releasable connection together with the projection at the edge of the sound opening. The connection may be an undercut, beads engaging each other from behind in the closed state, or a screw thread. Appropriate is an elastic cap which has a bead type edge which is pulled over an oppositely formed short projection at the outer opening of the sound conduction line and snaps in. A corresponding union can alternatively be obtained by means of a screw thread. The connections may be provided not only on the outside of the projection, but also on the inside of the exit opening of the sound conduction line or of the projection.

The projection at the housing which contains the sound exit opening may be connected with the prefabricated housing in the form of a baseplate, in that a plate of corresponding material is pierced by the sound conduction line, has a corresponding projection for the attachment of a cap, and is larger than the anticipated housing end face to be covered. After the cap has been installed, any protruding parts of the plate can be cut off and the edges adapted to the desired form.

If the protective cap is made of plastic or rubber, the outer opening can be cleaned simply by exchanging the cap. The cap and the projection may be made from the same materials used as for the manufacture of the housing, such as polyamide or polyacrylic glass.

BRIEF DESCRIPTION OF THE DRAWINGS

Exemplary and non-limiting preferred embodiments of the invention are shown in the drawings, in which.

DETAILED DESCRIPTION OF PREFERRED EMBODIMENTS

Figure 1:
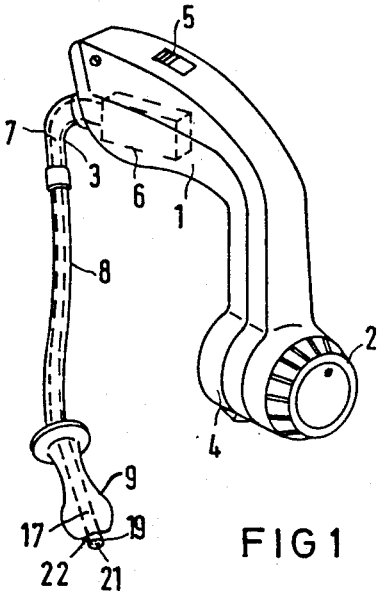
FIG. 1 shows the external view of a behind-the-ear hearing aid in which the sound conduction line is protected according to the invention.

In FIG. 1 is illustrated the housing 1 of a hearing aid to be worn behind the ear. At the end of this housing 1 is a volume control 2, and at the other is a wearing hook 3. Parallel with the control 2 is a chamber 4 for the battery for operation of an amplifier contained in the housing 1 and therefore not visible in the view of FIG. 1. The amplifier can be turned on by a switch 5. Sound enters through an opening in the end face of housing 1 located above the proximal end of hook 3 and gets to a microphone (not shown) which converts the sound into electrical signals for amplification in the amplifier. The amplified signals are then supplied to a receiver 6 and are retransformed into sound there. The sound emerging from receiver 6 is supplied, via a channel 7 which passes through the wearing hook 3, to a sound conduction tube 8 which connects channel 7 with a plug to be introduced into the ear, a so-called mold 9. At the free end of this mold 9 is a cover, permeable to sound via openings 21, which has the form of a cap 19 and which prevents cerumen from clogging the opening of channel 7.

Figure 3:
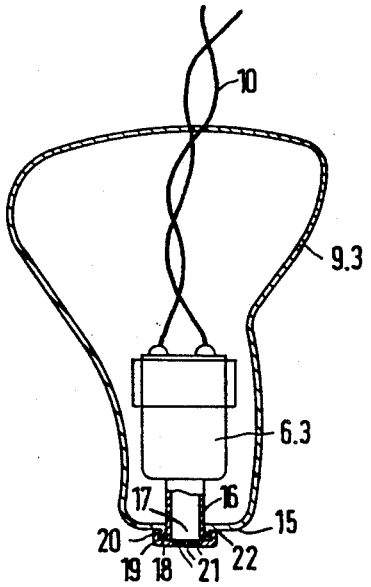
FIG. 3, an ear piece which, like the receiver of FIG. 2, can be used as external receiver in behind-the-ear devices or in pocket devices, where the receiver is accommodated in the housing.

The attachment and retention of cap 19 on the mold 9 are shown in FIG. 3.

Figure 2:
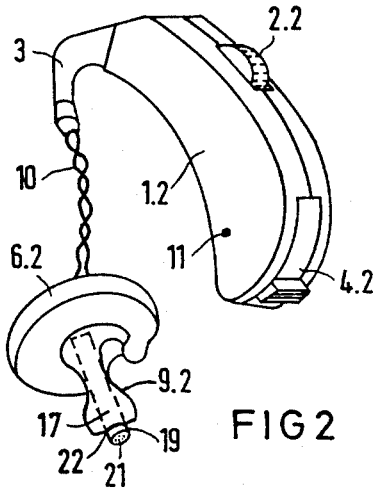
FIG. 2, shows an embodiment where the receiver is a so-called external receiver, i.e. is mounted on a housing or ear piece to be introduced into the ear.

In a preferred embodiment of a behind-the-ear device according to FIG. 2, the receiver 6.2 is connected via wires 10 with an amplifier accommodated in the housing 1.2 and not separately shown. The volume control for influencing the amplifier has a setting wheel 2.2 on the outwardly bent back of the housing 1.2. The battery of this device is contained in a receptacle 4.2 which lies at the free end of the housing and can be rotated about an axis 11 out of the housing 1.2 and out of contact with the amplifier. When the receptacle 4.2 is closed, the amplifier, i.e. the device, is turned on. Then, as in the embodiment of FIG. 1, acoustic signals are transformed in known manner into amplified electrical signals, which get via wires 10 to the receiver 6.2 placed on the ear piece 9.2. The sound of receiver 6.2 is conducted away via a channel 17 and can leave the latter via the openings 21 in the cap 19. Cap 19 is connected with the earpiece 9.3 according to FIG. 3.

Figure 4:
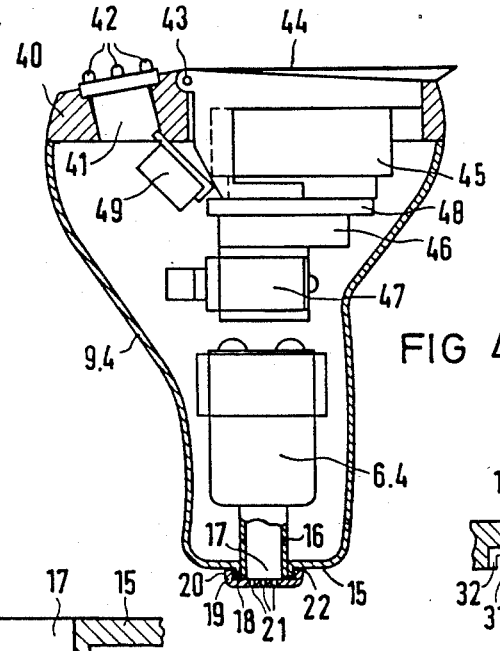
FIG. 4, an embodiment of the invention for an in-the-ear hearing aid.
Figure 5:
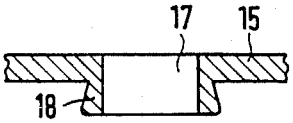
FIG. 5, a plate which has an undercut projection for receiving a protective cap at the exit of the sound conduction line.
Figure 6:
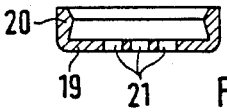
FIG. 6, a transverse section through a cap for use with the plate of FIG. 5.
Figure 7:
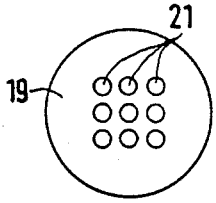
FIG. 7, the top view of the cap of FIG. 6.

For accommodation of the receiver 6.3 in a housing 9.3 according to FIG. 3, or of the receiver 6.4 in a housing 9.4 in an in-the-ear hearing aid according to FIG. 4, the sound exit opening 17 is connected via a tube 16 with the respective receiver 6.3 or 6.4. At the free end of the respective housing 9.3. or 9.4 to be introduced into the ear canal there is (as in the case of the mold 9 of FIG. 1 and the ear piece 9.2 of FIG. 2) a closure plate 15 with a hole in its center. A tube 16 is passed through this hole and connects the sound exit of the receiver with the exit opening 17 of the device. This opening 17 is in plate 15 and passes through a bead type projection 18, which is less thick at its proximal end than at its distal end. Thus an elastic cover, in the form of a cap 19, can engage by its bead type edge 20 behind the bevel of the projection 18 and snap in. On its large face, cap 19 has openings 21 for the passage of sound. If the holes (best shown in FIG. 7) become fouled, the elastic cap 19 can be removed from the projection 18 and replaced by a new one.

As can be seen from FIGS. 1 to 4, the end plate 15 of the housing 9, 9.2, 9.3 and 9.4 to be placed in the auditory meatus has a larger diameter than the cap 19. Preferably the diameter of the cap 19 is $\frac{1}{3}$ to $\frac{1}{4}$ the diameter of the end plate 15, the diameter of the end plate 15 corresponding essentially to the width of the ear canal to be closed. Also, the end plate 15 is relatively flat. In use, the cerumen collects at first mostly in the gap 22 between the end plate 15 and the cap 19, before it flows over the edge of the cap 19 to the clog the openings 21. Thus the openings of the cover 19 foul up less quickly so the cover 19 needs to be replaced or cleaned less often.

Figure 8:
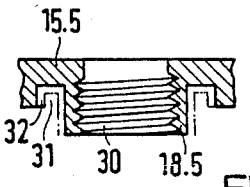
FIG. 8, a projection provided with a screw thread and surrounded by a recess.
Figure 9:
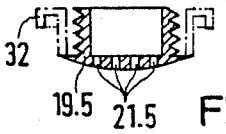
FIG. 9, a cap which fits the projection of FIG. 8.

FIG. 8 shows a modified design, in which parts corresponding to those in FIGS. 1 to 7 are marked with corresponding reference numerals with the addition of of a decimal suffix .5. In FIG. 8, the end plate 15.5 has a projection 18.5 with an interior thread 30 into which a closure cap 19.5 can be screwed. Around the projection 18.5 is a trench or groove 31 which serves to trap cerumen. After cover 19.5 has been removed, the trench 31 can easily be scraped out. Cleaning is simpler still if there is at the edge of cover 19.5 a lateral projection or arm 32, as indicated in broken lines in FIGS. 8 and 9, which covers the inner wall of trench 31 and can be removed together with cover 19.5.

Figure 10:
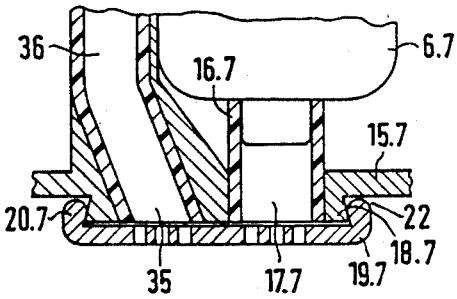
FIG. 10, a transverse section through an arrangement in which beside(s) the sound exit a vent opening within the arrangement is provided.
Figure 11:
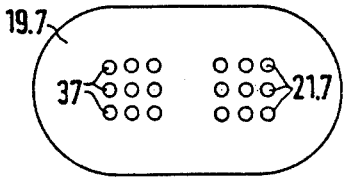
FIG. 11, the top view of the cap according to FIG. 10.

In FIGS. 10 and 11, the decimal suffix .7 relates the indicated part to the corresponding part shown in FIGS. 1–4. FIGS. 10 and 11 show the sound exit end of a housing, where beside(s) a sound exit opening 17.7 an opening 35 for a channel 36 is provided. Channel 36 is a vent in the earpiece. This design is analogous to the wedge-shaped undercut (dovetail connection) shown in FIGS. 3 to 7. The main different is that the cover 19.7 covers openings 17.7 and 35, the openings 21.7 in the cap 19.7 communicating with the opening 17.7 and the openings 37 in the cover 19.7 communicating with the opening 35 at the front of channel 36. In the operation (of the cover) as well as in its application complete agreement exists with the preferred embodiment of FIGS. 3 to 7.

The housing 9.4 of the in-the-ear hearing aid according to FIG. 4, to be introduced into the auditory canal of a person with hearing loss, comprises, in addition to the receiver 6.4, the following structural elements: A closure plate 40 (face plate) with volume control 41 containing setting elements 42; a battery compartment 44 hinged by axle 43 at the closure plate 40, for a battery 45; an amplifier 46 and a microphone 47; a foil 48 with printed circuit; a setter 49 for the transmission characteristic.

Those skilled in the art will understand that changes can be made in the preferred embodiments here described, and that these embodiments can be used for other purposes. Such changes and uses are within the scope of the invention, which is limited only by the claims which follow.

What is claimed is:

1. A hearing aid of the type in which, during use, an earpiece closes off the ear canal and a distal end of a sound-conducting tube extends into the auditory meatus, and in which the tube is mounted to the earpiece, the hearing aid comprising:

a protrusion surrounding said distal end and extending from said earpiece; and a cap detachably secured to said protrusion, said cap being perforated to permit sound to travel into the ear and wherein said cap and said earpiece form a cerumen-trapping gap;

wherein said earpiece of said hearing aid has a substantially flat end plate adjacent said protrusion and said end plate bears a groove which surrounds said protrusion.

2. The hearing aid of claim 1, wherein said protrusion has a maximum diameter at its distal end, and wherein said cap contains a recess which mates with said protrusion.

3. The hearing aid of claim 1, wherein said cap and protrusion are provided with mating threads.

4. The hearing aid of claim 1 wherein said cap is of an elastic material.

5. The hearing aid of claim 1, wherein the cap has an arm which mates with said groove.

6. The hearing aid of claim 1, further including a channel for venting the earpiece, the cap covering said channel and having perforations mating therewith.

7. The hearing aid of claim 1, wherein the hearing aid is of the type which is worn on the ear.

8. The hearing aid of claim 7, wherein said earpiece is a part of a mold which is plugged into a user's ear canal.

9. The hearing aid of claim 1, wherein the hearing aid is of the type which is worn in the ear.

10. The hearing aid of claim 9, wherein said earpiece is a part of a housing of the hearing aid and is made of the same material.

11. The hearing aid of claim 1, wherein the end plate and the cap each have circular peripheries and the periphery of the cap is smaller than the periphery of the end plate.

12. The hearing aid of claim 11, wherein the diameter of the cap is $\frac{1}{3}$ to $\frac{1}{4}$ of the diameter of the end plate.

13. The hearing aid of claim 1, wherein the cap and the earpiece are made of the same material.

* * * * *